United States Patent [19]

Polmear

[11] Patent Number: 4,772,342

[45] Date of Patent: Sep. 20, 1988

[54] WROUGHT AL/CU/MG-TYPE ALUMINUM ALLOY OF HIGH STRENGTH IN THE TEMPERATURE RANGE BETWEEN 0 AND 250 DEGREES C.

[75] Inventor: Ian J. Polmear, Box Hill North, Australia

[73] Assignee: BBC Brown, Boveri & Company, Limited, Baden, Switzerland

[21] Appl. No.: 922,680

[22] Filed: Oct. 24, 1986

[30] Foreign Application Priority Data

Oct. 31, 1985 [CH] Switzerland ..... 4696/85

[51] Int. Cl.[4] ..... C22C 21/16

[52] U.S. Cl. ..... 148/418; 148/12.7 A; 148/439

[58] Field of Search ..... 420/533, 535; 148/418, 148/439, 12.7 A, 159

[56] References Cited

U.S. PATENT DOCUMENTS 3,288,601 11/1966 Flemings et al. ..... 420/535
3,475,166 10/1969 Raffin ..... 420/532
3,925,067 12/1975 Sperry et al. ..... 420/535

FOREIGN PATENT DOCUMENTS 1320271 6/1973 United Kingdom .

*Primary Examiner*—R. Dean
*Attorney, Agent, or Firm*—Oblon, Fisher, Spivak, McClelland & Maier

[57] ABSTRACT

A wrought Al/Cu/Mg type aluminum alloy of high strength in the temperature range between 0 and 250° C., having the following composition:

Cu=5.0 to 7.0% by weight
Mg=0.3 to 0.8% by weight
Ag=0.2 to 1.0% by weight
Mn=0.3 to 1.0% by weight
Zr=0.1 to 0.25% by weight
V=0.05 to 0.15% by weight
Si<0.10% by weight In this artificially aged state, the yield strength (0.2% limit) reached is more than 500 MPa at room temperature, almost 400 MPa at 200° C. and about 300 MPa at 250° C. At 180° C., the creep strength is still more than 250 MPa after 500 hours.

4 Claims, 2 Drawing Sheets

HB
170
160
150
140
130
120
110
100
0
0,1
0,2
0,3
0,4
0,5
0,6
% Ag
1
2
3
4

HB
180
170
160
150
140
130
120
110
100
0,5
1
5
10
50
100
t (h)
5
6

WROUGHT AL/CU/MG-TYPE ALUMINUM ALLOY OF HIGH STRENGTH IN THE TEMPERATURE RANGE BETWEEN 0 AND 250 DEGREES C.

The invention relates to a wrought aluminum alloy.

Aluminum alloys of the Al/Cu/Mg type have been known for decades. Repeated attempts have been made to improve this classic precipitation-hardening alloy by further additions and to optimize its properties for the particular application. To improve the strength properties, alloying of casting alloys of this type with silver has been proposed, inter alia (see, for example, U.S. Pat. Nos. 3,288,601, 3,475,166 and 3,925,067). Similar proposals were also made in the field of wrought alloys (compare GB-A-No. 1,320,271). To improve the microstructure, the alloys also contain further additions, for example manganese, titanium and the like.

Wrought Al/Cu/Mg alloys with additions of iron and nickel were developed for operating temperatures up to 100 . . . 150° C. (compare alloy 2618 according to the U.S. standard). These alloys resulted in most cases from corresponding casting alloys with added nickel. However, since they suffer a comparatively very pronounced decrease in strength above 150° C., they cannot really be described as "high-temperature" aluminum alloys in the current sense. The known alloys do not completely exhaust the scope for improving the strength properties. In particular, they do not meet the requirements at relatively high temperatures (up to, for example, 250° C.), such as are necessary for numerous industrial uses.

There is therefore a great demand for a further improvement in wrought aluminum alloys, in particular in their strength properties at elevated temperature.

It is the object of the invention to provide a wrought aluminum alloy which can be produced by fusion metallurgy in simple conventional processes and which, in the temperature range from 0° to 250° C. in the precipitation-hardened state, has markedly higher strength properties than conventional alloys.

Figure 1:
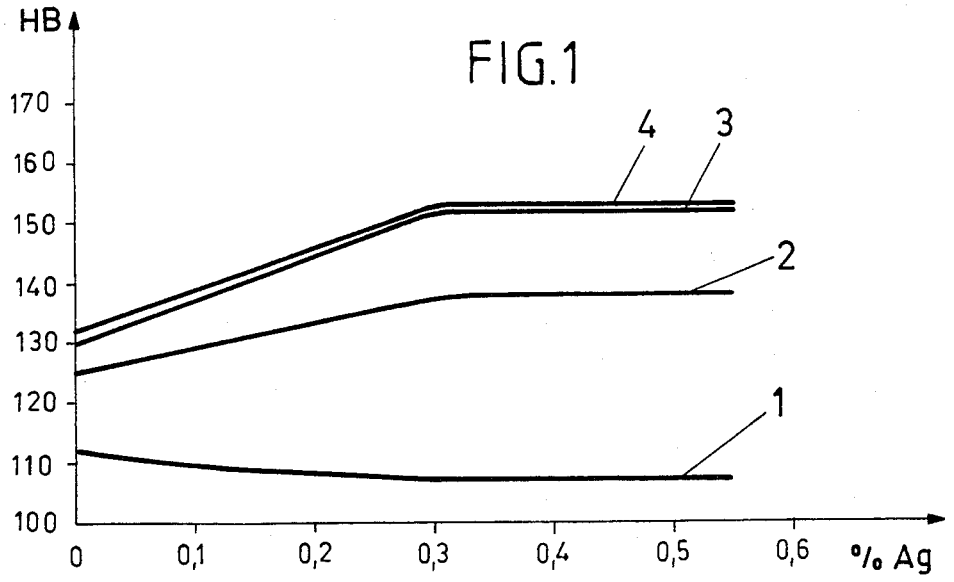
Figure 2:
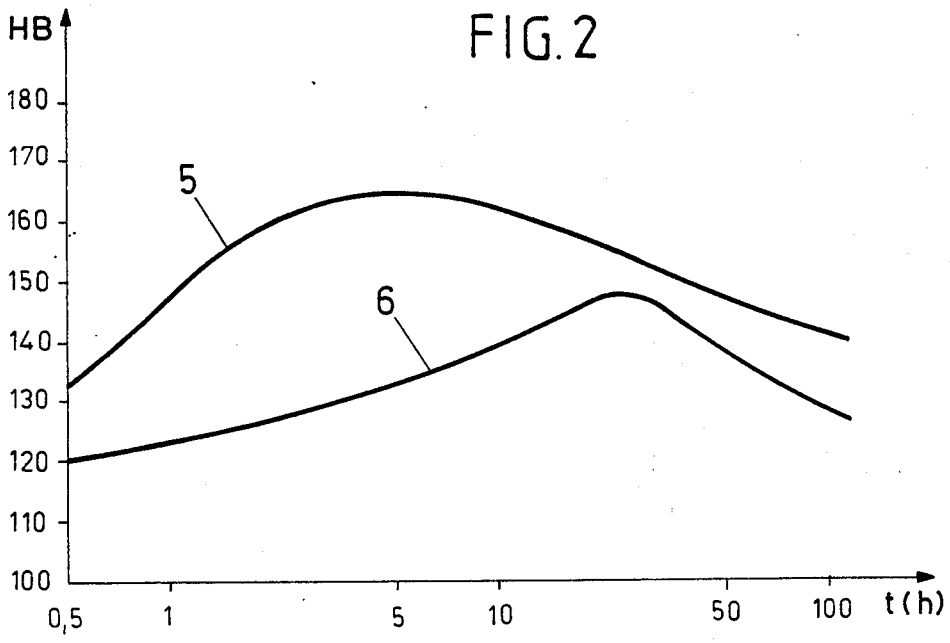
Figure 3:
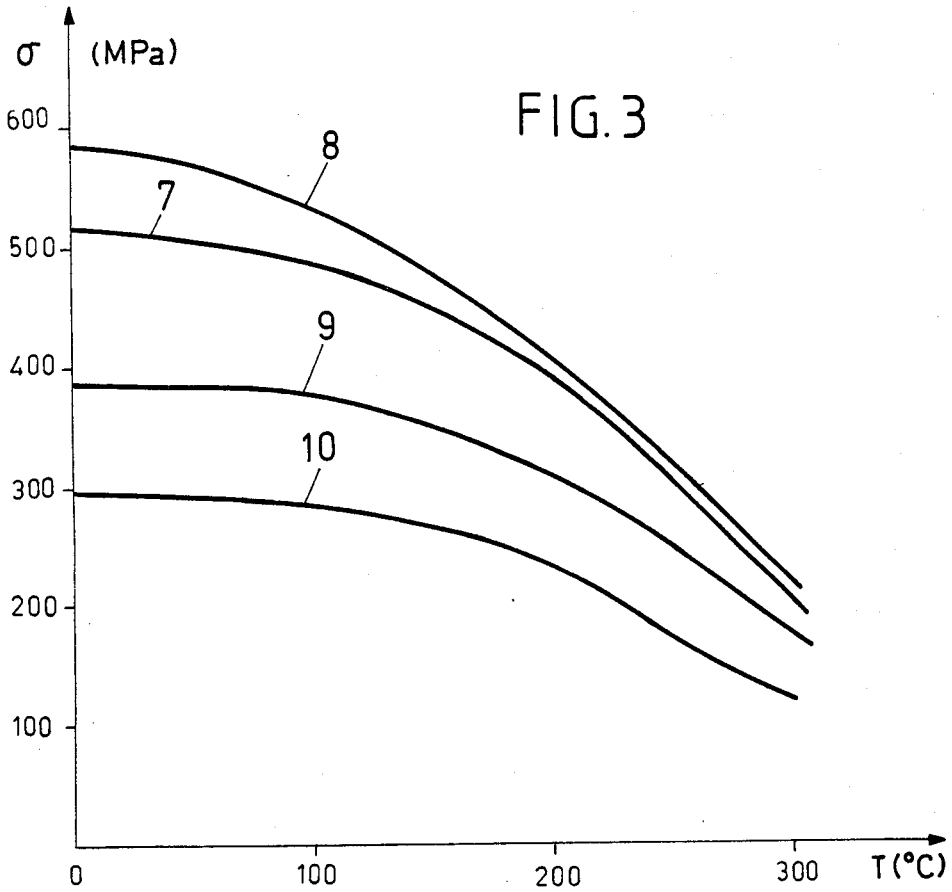
Figure 4:
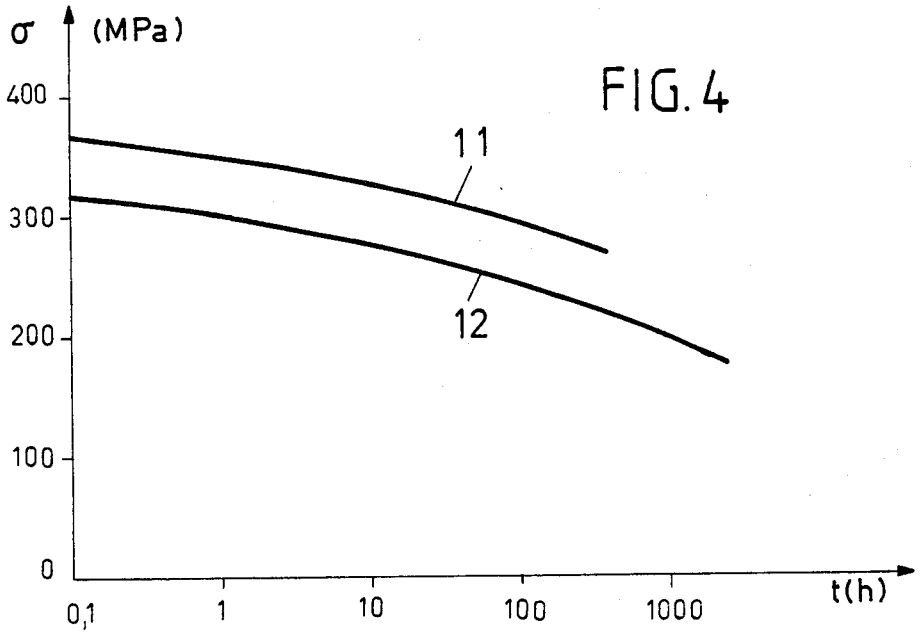

The invention is described by reference to the illustrative embodiments which follow and which are explained in more detail by figures, in which:

FIG. 1 shows a diagram of the Brinell hardness as a function of the Ag content for an Al/Cu/Mg and Mg/Ag alloy, FIG. 2 shows a diagram of the Brinell hardness curve as a function of the precipitation-hardening time for a novel alloy as compared with a known commercial alloy, FIG. 3 shows a diagram of the yield strength curve and tensile strength as a function of the test temperature for a novel alloy as compared with two known commercial alloys, and FIG. 4 shows a diagram of the creep strength of a novel alloy compared with a known commercial alloy.

FIG. 1 diagrammatically shows the Brinell hardness of an Al/Cu/Ag and Al/Cu/Mg/Ag alloy as a function of the Ag content. The Mg content is plotted here as the parameter. Curve 1 relates to an Mg-free alloy, curve 2 relates to an Mg content of 0.3% by weight, curve 3 relates to an Mg content of 0.4% by weight and curve 4 relates to an Mg content of 0.5% by weight. The alloy had a constant Cu content of 6.3% by weight, the remainder being aluminum. The values related to the state obtained after solution annealing, quenching and artificial aging. With increasing alloy elements content, the Brinell hardness rose up to a flat maximum.

FIG. 2 shows a diagram of the Brinell hardness as a function of the precipitation-hardening time for a novel alloy (corresponding to curve 5) as compared with a known commercial alloy (corresponding to curve 6). The novel alloy had the following composition:

Cu=6.0% by weight
Mg=0.5% by weight
Ag=0.4% by weight
Mn=0.5% by weight
Zr=0.15% by weight
V=0.10% by weight
Si=0.04% by weight
Fe=0.15% by weight
Al=remainder The known commercial comparison alloy according to U.S. standard No. 2618 had the following composition:

Cu=2.3% by weight
Mg=1.5% by weight
Fe=1.0% by weight
Ni=1.0% by weight
Si=0.2% by weight The two alloys were treated in an analogous manner and were present in similar states: solution annealing, quenching in cold water and precipitation hardening (artificial aging) at 195° C. The novel alloy reached a maximum hardness of 165 Brinell units after 5 hours precipitation hardening, whereas the comparison alloy No. 2618 reached only about 145 Brinell units after about 30 hours precipitation hardening.

FIG. 3 shows the trend of the yield strength (0.2% limit, corresponding to curve 7) and the tensile strength (corresponding to curve 8) as a function of the test temperature, assuming a holding time of 0.5 hour at this temperature, for a novel alloy as compared with two known commercial alloys. The composition of the novel alloy corresponded to that described under FIG. 2. The composition of the comparison alloy No. 2618 can be taken from the description relating to FIG. 2. The composition of the comparison alloy according to U.S. standard No. 2219 is as follows:

Cu=6.3% by weight
Mn=0.3% by weight
Zr=0.18% by weight
V=0.10% by weight
Fe=0.30% by weight (max)
Mg=0.02% by weight (max)
Si=0.20% by weight (max)

Curve 9 relates to the trend of the yield strength (0.2% limit) of alloy No. 2618, and curve 10 relates to that of alloy No. 2219. The yield strength values of the novel alloy are markedly higher than those of the known commercial alloys.

FIG. 4 shows an illustration of the creep strength at 180° C. for a novel alloy as compared with a known commercial alloy. The novel alloy had the composition indicated under FIG. 2, whereas the comparison alloy was No. 2618 described above. Curve 11 relates to the novel alloy, whereas curve 12 applies to the known alloy No. 2618. The values reached by the novel alloy are about 20% higher than those of the comparison alloy.

Illustrative Example 1

In aluminum alloy of the following composition:

Cu=6.0% by weight

Mg=0.5% by weight
Ag=0.4% by weight
Mn=0.5% by weight
Zr=0.15% by weight
V=0.10% by weight
Si=0.04% by weight
Al=remainder was smelted in a crucible in an induction furnace.

As the starting materials for the aluminum, copper, magnesium and silver components, the pure elements were melted. The purity of the aluminum was 99.9%. The manganese, zirconium and vanadium components were added as aluminum master alloys each with 50% by weight of the particular element. The total smelted mass was about 2 kg. The melt was brought to a casting temperature of 740° C. and cast into a slightly conical, water-cooled copper mold. The crude ingot had a minimum diameter of about 17 mm, and a height of about 160 mm. After cooling, it was homogenized for 24 hours at a temperature of 485° C. After mechanical removal of the casting skin, cylindrical extrusion billets of 36 mm diameter and 36 mm height were produced from the ingot by turning. These billets were individually extruded at a temperature of 420° C. in an extruder to give a round bar of 9 mm diameter. The effective reduction ratio was 13:1. Sections of 50 mm length were severed from this rod and further treated individually. Initially, the specimens thus obtained were subjected to solution annealing at a temperature of 530° C. for a period of 3 hours and then quenched in cold water. The specimens were then precipitation-hardened for 7 hours at a temperature of 195° C. (artificial aging).

The strength properties were tested both at room temperature and at elevated temperature in each case after a preceding holding time of 0.5 hour and 1000 hours at the respective test temperature. The results for the 0.5 hour holding time are shown in the diagrams corresponding to FIGS. 2, 3 and 4. This gives the following values:

Brinell hardness HB: A flat maximum of 165 units in the range from about 4 to 7 h precipitation-hardening time. Precipitation-hardening temperature 195 ® C. Curve 4.

| Yield strength (0.25 limit): Curve 6. | | | |
|---|---|---|---|
| Test temperature: | 20 | 200 | 250° C. |
| Yield strength | 518 | 393 | 303 MPa |

The elongation was 7.5% at 20° C. and 11.0% at 200° C.

Illustrative Example 2

Analagously to Example 1, an alloy according to the following composition was smelted and further processed to give rod sections:

Cu=5.3% by weight
Mg=0.6% by weight
Ag=0.3% by weight
Mn=0.5% by weight
Zr=0.25% by weight
V=0.15% by weight
Si=0.08% by weight
Al=remainder The specimens of the alloy were solution-annealed at a temperature of 533° C. and quenched in boiling water. Artificial aging was carried out at 175° C. for a period of 50 hours.

The strength values were on average about 5% below those of Example 1.

| Yield strength (0.2% limit): | | | |
|---|---|---|---|
| Test temperature: | 20 | 200 | 250° C. |
| Yield strength: | 490 | 374 | 286 MPa |

Illustrative Example 3

Analogously to example 1, an alloy of the following composition was smelted and further processed to give rod sections:

Cu=6.7% by weight
Mg=0.4% by weight
Ag=0.8% by weight
Mn=0.8% by weight
Zr=0.15% by weight
V=0.05% by weight
Si=0.06% by weight
Al=remainder The specimens of the alloy were solution-annealed at a temperature of 525° C. and quenched in cold water. Artificial aging was carried out at a temperature of 205° C. for a period of 2 hours.

The strength values were comparable with those of Example 1.

| Yield strength (0.2% limit): | | | |
|---|---|---|---|
| Test temperature: | 0 | 200 | 250° C. |
| Yield strength | 510 | 390 | 301 MPa |

Illustrative Example 4

Analogously to illustrative Example 1, an aluminum alloy corresponding to this Example was smelted. The melt was brought to a temperature of 700° C. and atomized in a device by means of a gas jet to give a fine powder. The gas was nitrogen under a pressure of 60 bar. Only those fractions of the fine-grained powder produced were used further which had a particle diameter of less than 50 μm.

The powder was filled into aluminum cans and degassed for 5 hours at 450° C. The filled cans were then hot-pressed, and the extrusion billets produced in this way were processed further in an extruder at 420° C. to give rods of 9 mm diameter. The material was of 100% density. Sections of the rods were then subjected to solution annealing for 3 hours at a temperature of 530° C. and then quenched in cold water. The specimens were artificially aged for 7 hours at 195° C. In this case, the strength maximum was reached after only about 5 hours. The mechanical properties of the specimens produced by powder-metallurgical means were on average even slightly above those of the specimens produced by fusion metallurgy.

At room temperature, the following values were reached:

| | |
|---|---|
| Yield strength (0.2% limit): | 520 MPa |
| Ultimate tensile strength: | 620 MPa |
| Elongation: | 8.5% |

Regarding alloying technology, the following should be added:

Quite generally, the additional impurities, which have to be accepted in industrial manufacture of the alloys, should be kept as low as possible and should not exceed a total value of 0.25% by weight for all elements taken together. The silicon content should be kept as low as possible in order to avoid the formation of low-melting eutectics in the grain boundaries. Moreover, intermetallic compounds with magnesium, which would represent a loss of the latter metal for its advantageous effect in conjunction with silver, should be avoided (see FIG. 1). For this reason, the silicon content should remain below 0.10% by weight. The transition metals manganese, zirconium and vanadium are intended for grain refinement and for the formation of intermetallic phases which, in a finely divided form, effect dispersion-hardening and above all contribute to an increase in high-temperature strength. Further additions of iron, nickel and chromium, having similar effects, to the claimed alloy compositions are feasible. However, these elements have the disadvantage that they form additional intermetallic compounds with copper, so that the content of this later element available for the precipitation hardening and the strength of the matrix is reduced. In any case, caution is advisable in the use of iron and/or nickel, which can at most be added in contents from 0.1 to 1.5% by weight as a maximum.

The invention is not restricted to the illustrative examples. In principle, the compositions can be selected within the following limits:

Cu=5.0 to 7.0% by weight
Mg=0.3 to 0.8% by weight
Ag=0.2 to 1.0% by weight
Mn=0.3 to 1.0% by weight
Zr=0.1 to 0.25% by weight
V=0.05 to 0.15% by weight
Si<0.10% by weight
Al=remainder Preferably, the aluminum alloys have the following compositions:

Cu=5.5 to 6.5% by weight
Mg=0.4 to 0.6% by weight
Ag=0.2 to 0.8% by weight
Mn=0.3 to 0.8% by weight
Zr=0.1 to 0.2% by weight
V=0.05 to 0.15% by weight
Si<0.05% by weight
Al=remainder Solution annealing is preferably carried out in the temperature range from 528° to 533° C., the upper temperature limit being given by the need to avoid local incipient melting due to the appearance of low-melting phases. Deviating in part from the data given in the examples, the artificial aging can be carried out in various ways, exploiting the temperature/time relationship, preferably in accordance with the following scheme:

| Artificial aging temperature | Period |
|---|---|
| 175° C. | 20 to 50 hours |
| 185° C. | 9 to 18 hours |
| 195° C. | 4 to 7 hours |
| 205° C. | 2 to 3 hours |

With the wrought alloys according to the invention, light-weight materials are provided which have good strength properties, in particular in the temperature range from room temperature to 250° C., and can be easily produced by conventional fusion-metallurgical methods.

I claim:

1. A wrought Al/Cu/Mg-type aluminum alloy of high strength in the temperature range between 0° and 250° C., consisting essentially of the following composition:

Cu=5.0 to 7.0% by weight
Mg=0.3 to 0.8% by weight
Ag=0.2 to 1.0% by weight
Mn=0.3 to 1.0% by weight
Zr=0.1 to 0.25% by weight
V=0.05 to 0.15% by weight
Si<0.10% by weight
Al=remainder 2. A wrought aluminum alloy as claimed in claim 1, consisting essentially of the following composition:

Cu=5.5 to 6.5% by weight
Mg=0.4 to 0.6% by weight
Ag=0.2 to 0.8% by weight
Mn=0.3 to 0.8% by weight
Zr=0.1 to 0.2% by weight
V=0.05 to 0.15% by weight
Si<0.05% by weight
Al=remainder 3. A wrought aluminum alloy as claimed in claim 1, consisting essentially of the following composition:

Cu=6.0% by weight
Mg=0.5% by weight
Ag=0.4% by weight
Mn=0.5% by weight
Zr=0.15% by weight
V=0.10% by weight
Si<0.05% by weight
Al=remainder 4. A wrought aluminium alloy as claimed in claim 1, which, in the state after solution annealing, quenching in cold water and artificial aging for precipitation hardening, has at room temperature a 0.2% yield strength of at least 510 MPa and an ultimate tensile strength of at least 575 MPa and, at a temperature of 200° C. after a holding time of 0.5 hour, a 0.2% yield strength of at least 390 MPa and an ultimate tensile strength of at least 405 MPa.

* * * * *